US007806256B2

(12) United States Patent
Wildauer et al.

(10) Patent No.: US 7,806,256 B2
(45) Date of Patent: Oct. 5, 2010

(54) PLUNGER CADDY ASSEMBLY

(75) Inventors: John B. Wildauer, Cherry Hill, NJ (US); Victor Hoernig, Lowell, IN (US); ManKi Yoo, Morton Grove, IL (US); Randall Paul Schmitt, Clinton Township, MI (US)

(73) Assignee: Cobra Products, Inc., Bridgeport, NJ (US)

( * ) Notice: Subject to any disclaimer, the term of this patent is extended or adjusted under 35 U.S.C. 154(b) by 5 days.

(21) Appl. No.: 12/243,985

(22) Filed: Oct. 2, 2008

(65) Prior Publication Data

US 2010/0084292 A1 Apr. 8, 2010

(51) Int. Cl.
*A45D 44/18* (2006.01)

(52) U.S. Cl. ..... 206/15.3; 206/361; 206/362.3; 312/207

(58) Field of Classification Search ..... 206/361, 206/362.2, 362.3, 15.2, 15.3, 209.1, 209; 312/207, 206; 211/65
See application file for complete search history.

(56) References Cited

U.S. PATENT DOCUMENTS

| | | | | |
|---|---|---|---|---|
| 2,757,787 | A * | 8/1956 | Sergent | 206/361 |
| 4,033,650 | A * | 7/1977 | Alissandratos | 312/206 |
| 4,415,211 | A * | 11/1983 | Alissandratos | 312/206 |
| 4,638,910 | A * | 1/1987 | Bokmiller | 206/15.2 |
| 5,836,322 | A * | 11/1998 | Borger et al. | 134/42 |
| 5,924,566 | A | 7/1999 | Gibbs | |
| 5,941,379 | A * | 8/1999 | Barardo | 206/209 |
| 6,601,700 | B1 * | 8/2003 | Rudnick et al. | 206/349 |
| 6,719,134 | B2 | 4/2004 | Phillips et al. | |
| 6,926,137 | B2 * | 8/2005 | Rudnick et al. | 206/15.3 |
| 6,951,281 | B1 * | 10/2005 | Jeffery | 206/349 |
| 7,328,793 | B2 * | 2/2008 | Leaphart et al. | 206/349 |
| 2006/0037878 | A1 * | 2/2006 | Brown et al. | 206/361 |
| 2008/0066247 | A1 * | 3/2008 | Yang et al. | 15/104.94 |
| 2008/0135433 | A1 * | 6/2008 | Weis et al. | 206/362.2 |

* cited by examiner

*Primary Examiner*—David T Fidei
(74) *Attorney, Agent, or Firm*—Carlson, Gaskey & Olds PC

(57) ABSTRACT

A plunger caddy assembly includes a plunger and a caddy that receives the plunger. The plunger is selectively rotatable in a first direction relative to the caddy to release the plunger from the caddy. The plunger is selectively rotatable in a second direction relative to the caddy to secure the plunger within the caddy.

11 Claims, 13 Drawing Sheets

PLUNGER CADDY ASSEMBLY

BACKGROUND OF THE DISCLOSURE

This disclosure generally relates to toiletry devices, and more particularly to a plunger caddy assembly for storing a toilet plunger.

A variety of containers and/or caddy assemblies for storing toilet plungers are known. A toilet plunger typically includes a handle and a suction head that is used to plunge a bathroom toilet. The container provides a convenient receptacle for receiving the toilet plunger after its use. The container also partially masks the unsightly view of the toilet plunger where positioned adjacent to the toilet within a bathroom.

Known containers for storing toilet plungers are not without their disadvantages. For example, many containers are often unattractive in appearance, and may not blend in with the overall décor of the bathroom. In addition, a user must often make contact with both the toilet plunger and the container to store and remove the toilet plunger in and from the container. This may be inconvenient to the user and unsanitary. One further problem is that the toilet plunger may inadvertently become dislodged from the container during transport.

Accordingly, it is desirable to provide a caddy assembly for a toilet plunger that may be operated in a hands-free manner, is decorative, and is transportable in a simple and sanitary fashion.

SUMMARY OF THE DISCLOSURE

A plunger caddy assembly includes a plunger and a caddy that receives the plunger. The plunger is selectively rotatable in a first direction relative to the caddy to release the plunger from the caddy. The plunger is selectively rotatable in a second direction relative to the caddy to secure the plunger within the caddy.

A method of storing a plunger within a caddy includes rotating the plunger in a first direction to release the plunger from the caddy, and rotating the plunger in a second direction that is opposite from the first direction to secure the plunger within the caddy.

A caddy for storing a plunger includes a base, a tray and at least two clamshell doors. The tray is received by the base. The clamshell doors contact the tray. The tray is rotatable relative to the base to move the clamshell doors between a first position and a second position.

The various features and advantages of this disclosure will become apparent from the following detailed description. The drawings that accompany the detailed description can be briefly described as follows.

DETAILED DESCRIPTION OF THE DISCLOSED EMBODIMENT

Figure 1:
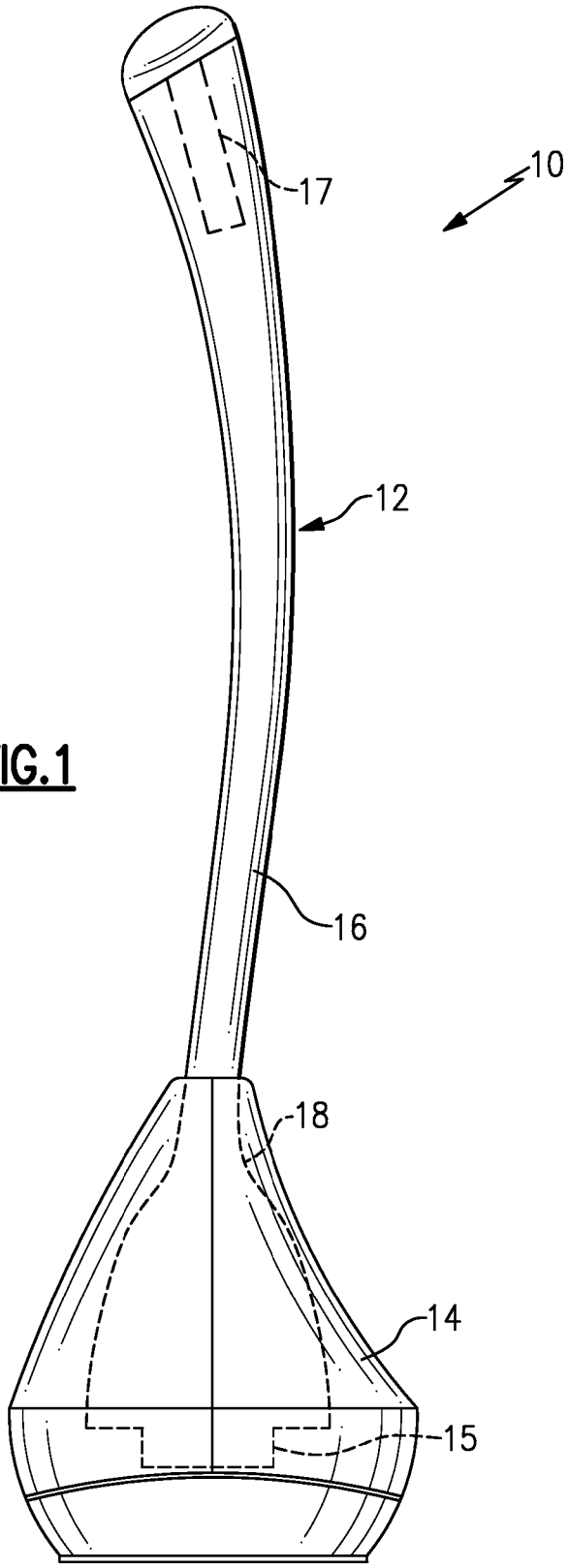
FIG. 1 schematically illustrates an example plunger caddy assembly for storing a toilet plunger.

FIG. 1 illustrates a plunger caddy assembly 10 that includes a plunger 12 and a caddy 14 for receiving and storing the plunger 12. The plunger caddy assembly 10 is utilized in a bathroom, for example, to store the plunger 12 in an aesthetically pleasing manner. The plunger 12 includes a handle 16 and a suction head 18. In one example, the handle 16 is curved to provide a more ergonomic and aesthetically pleasing design. In another example, the handle 16 includes a cavity 17 for receiving a toiletry device, such as a drain cleaning snake, for example. The suction head 18 may include a variety of sizes and shapes as are known in the art.

The plunger 12 is selectively removable from the caddy 14 for use with a bathroom toilet, for example. It should be understood that the plunger 12 may be used with any household drain, including but not limited to, bathtub and shower drains. The plunger is conveniently stored and removed from the caddy 14 in a hands-free manner, as is further discussed below.

Figure 2:
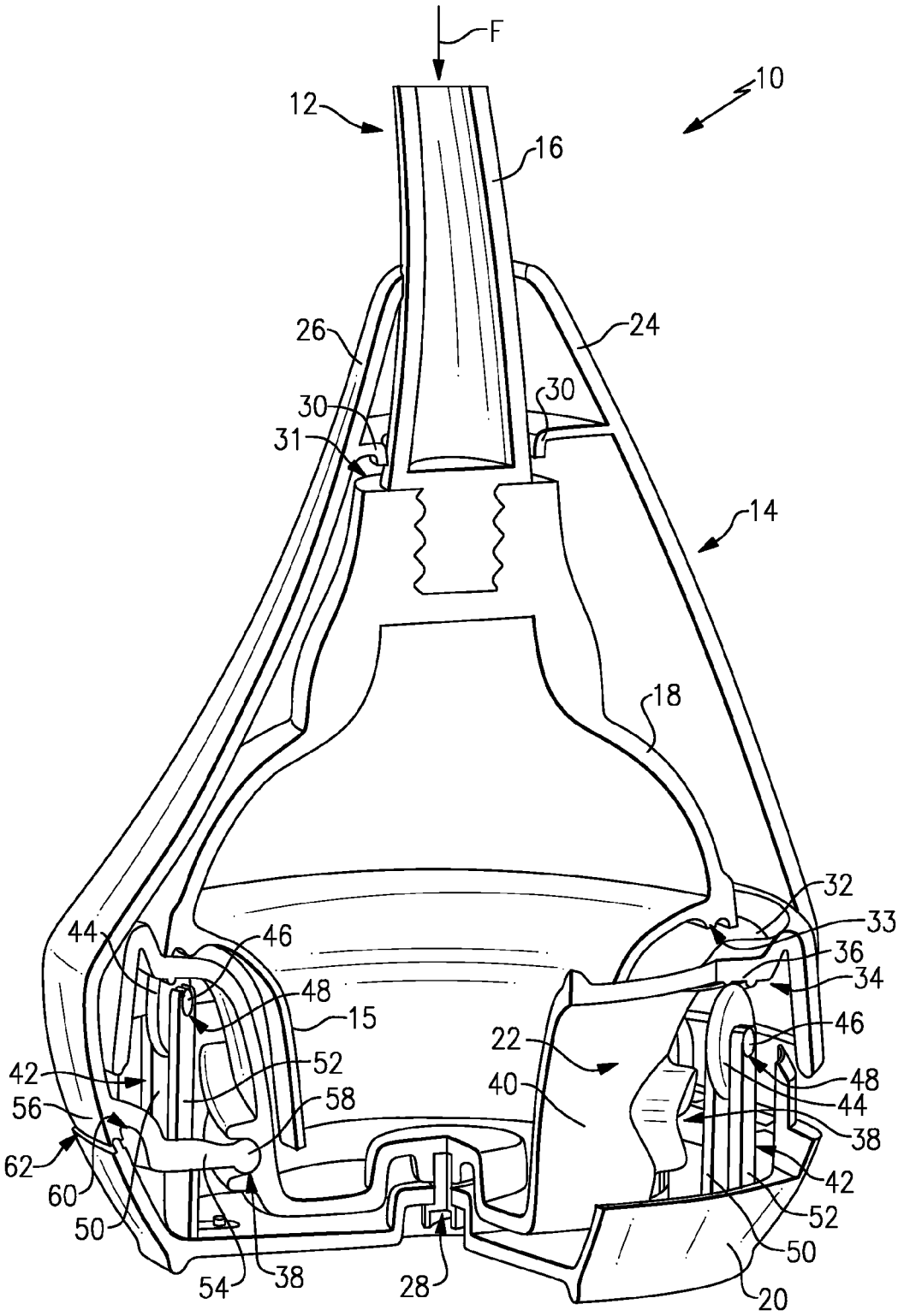
FIG. 2 illustrates a partial sectional view of the example plunger caddy assembly of FIG. 1.

Referring to FIG. 2, the caddy 14 includes a base 20, a tray 22 and a pair of clamshell doors 24, 26. The tray 22 is connected to the base 20 via a fastener 28, in this example. In another example, the tray 22 and the base form a snap fit assembly (See FIG. 5), as is further discussed below. In one example, the tray 22 is rotatable relative to the base 20. The clamshell doors 24, 26 are pivotably attached to the base 20.

The plunger 12 is received within the caddy 14 for storage. In one example, the suction head 18 is received by the tray 22 of the caddy 14. The clam shell doors 24, 26 each include a rib 30 for selectively receiving and securing the handle 16 of the plunger 12 relative to the caddy 14. That is, once the ribs 30 are secured about the handle 16, the plunger caddy assembly 10 may be transported with a reduced risk of separation of the plunger 12 from the caddy 14. In one example, the ribs 30 are secured about the plunger 12 adjacent to an interface 31 between the handle 16 and the suction head 18.

In one example, the suction head 18 of the plunger 12 includes an extendable sleeve 15. The extendable sleeve 15 is extended from the suction head 18 in a hands-free manner. That is, the extendable sleeve 15 is extended automatically by applying a downward force F on the handle 16 prior to removing the plunger from the caddy 14. The downward force F automatically extends the extendable sleeve 15 from the suction head 18 when the plunger 12 is removed from the caddy 14. The extendable sleeve 15 is easily retracted within the suction head 18 by pressing the extendable sleeve 15 against any relatively firm surface.

Rotation of the handle 16 of the plunger 12 within the caddy 14 is translated into rotation of the tray 22 relative to the base 20, and is further translated into pivoting of the clamshell doors 24, 26 about the base 20 to separate and open the clamshell doors 24, 26. The plunger 12 is released from the caddy 14 once the clamshell doors 24, 26 are separated.

In one example, the tray 22 includes a body portion 40 having a generally cup-like shape. The tray 22 forms a lip 32 that extends about the outer periphery of the tray 22. The lip 32 receives a corresponding lip 33 of the suction head 18 to store the plunger 12 within the caddy 14. The lip 33 also includes a plurality of bumps 35. The plurality of bumps 35 create interference between the suction head 18 and the tray 22 during rotation of the handle 16 to translate the rotation of the plunger 12 to the tray 22.

A bottom side 34 of the lip 32 includes a track 36 that interacts with a portion of the base 20 to allow for rotation of the tray 22 relative to the base 20. In one example, the track 36 is formed over a range of 360° of the bottom side 34 of the lip 32. The tray 22 also includes indentations 38 that interact with portions of the clamshell doors 24, 26 to translate the rotational movement of the tray 22 to the clamshell doors 24, 26. In one example, the indentations 38 are positioned on the body portion 40 of the tray 22 and are spaced apart at approximately 180°.

The base 20 includes a plurality of posts 42 that transversely protrude from the base 20 in a vertical direction. That is, the posts 42 extend between the base 20 and the bottom side 34 of the lip 32 of the tray 22. Each of the plurality of posts 42 receives a wheel 44. In one example, each wheel 44 includes an axle 46 that is received within an opening 48 formed in the post 42. In another example, the posts 42 include a first leg 50 and a second leg 52. However, a worker of ordinary skill in the art would understand that the posts 42 may include any size, shape or structural design.

The posts 42 are disposed about the base 20 over a range of 360° and are equidistantly spaced, in one example. In this example, the base 20 includes four posts 42 (two shown) that receive four wheels 44. The wheels 44 are received within the track 36 of the tray 22 to permit rotation of the tray 22 relative to the base 20. In one example, the track 36 is slightly angled relative to the lip 32 to improve the rotatability of the tray 22 relative to the base 20 via the wheels 44. The posts 42 are integrally molded with the base 20, in one example. However, the posts 42 are attachable to the base 20 in any known manner.

The clamshell doors 24, 26 are pivotably attached to the base 20. In one example, each clamshell door 24, 26 extends over a range of 180° relative to the base 20. That is, each clamshell door 24, 26 extends over a distance equal to half of the circumference of the base 20 to completely surround the suction head 18 where stored within the plunger caddy assembly 10.

Each clamshell door 24, 26 includes a cantilevered arm 54 that extends from a base 56 of each clamshell door 24, 26. The cantilevered arms 54 include a distal end 58 that is received by the indentations 38 formed within the body portion 40 of the tray 22. That is, the cantilevered arms 54 extend between the clamshell doors 24, 26 and the tray 22 and translate rotational movement of the tray 22 into radial movement of the clamshell doors 24, 26. In one example, the distal ends 58 of the cantilevered arms 54 are slidably received by the indentations 38 of the tray 22. The cantilevered arms 54 and the indentations 38 are spaced apart by approximately 180°, in one example.

The cantilevered arms 54 also include a pivot portion 60. The clamshell doors 24, 26 pivot about the base 20 at the pivot portions 60. In one example, the pivot portions 60 of the cantilevered arms 54 are curved. In another example, the pivot portions 60 are pivotable about a ledge 62 of the base 20 in response to rotation of the tray 22 relative to the base 20.

Figure 3A:
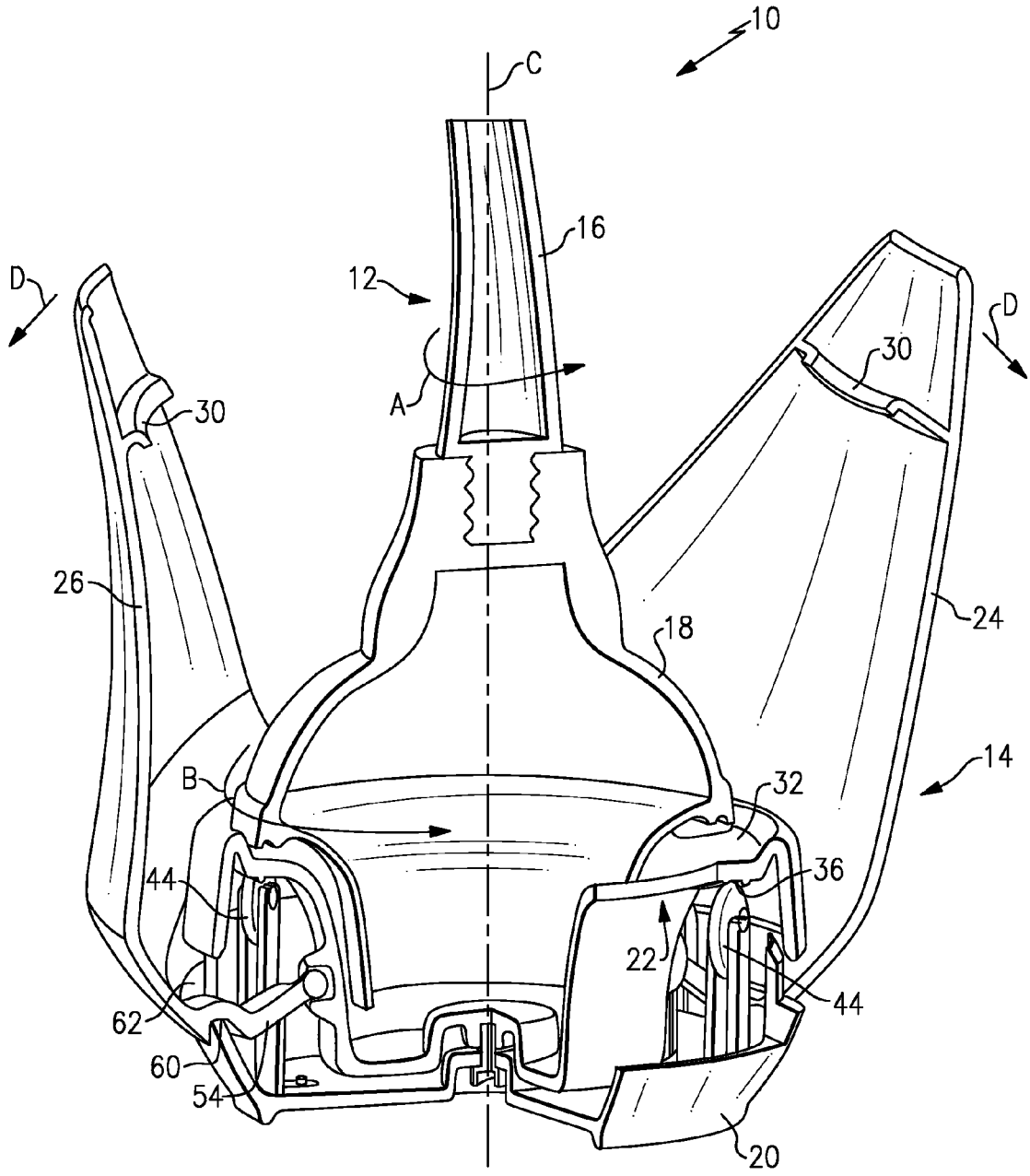
FIGS. 3A and 3B schematically illustrate removal of a plunger from an example plunger caddy assembly.
Figure 3B:
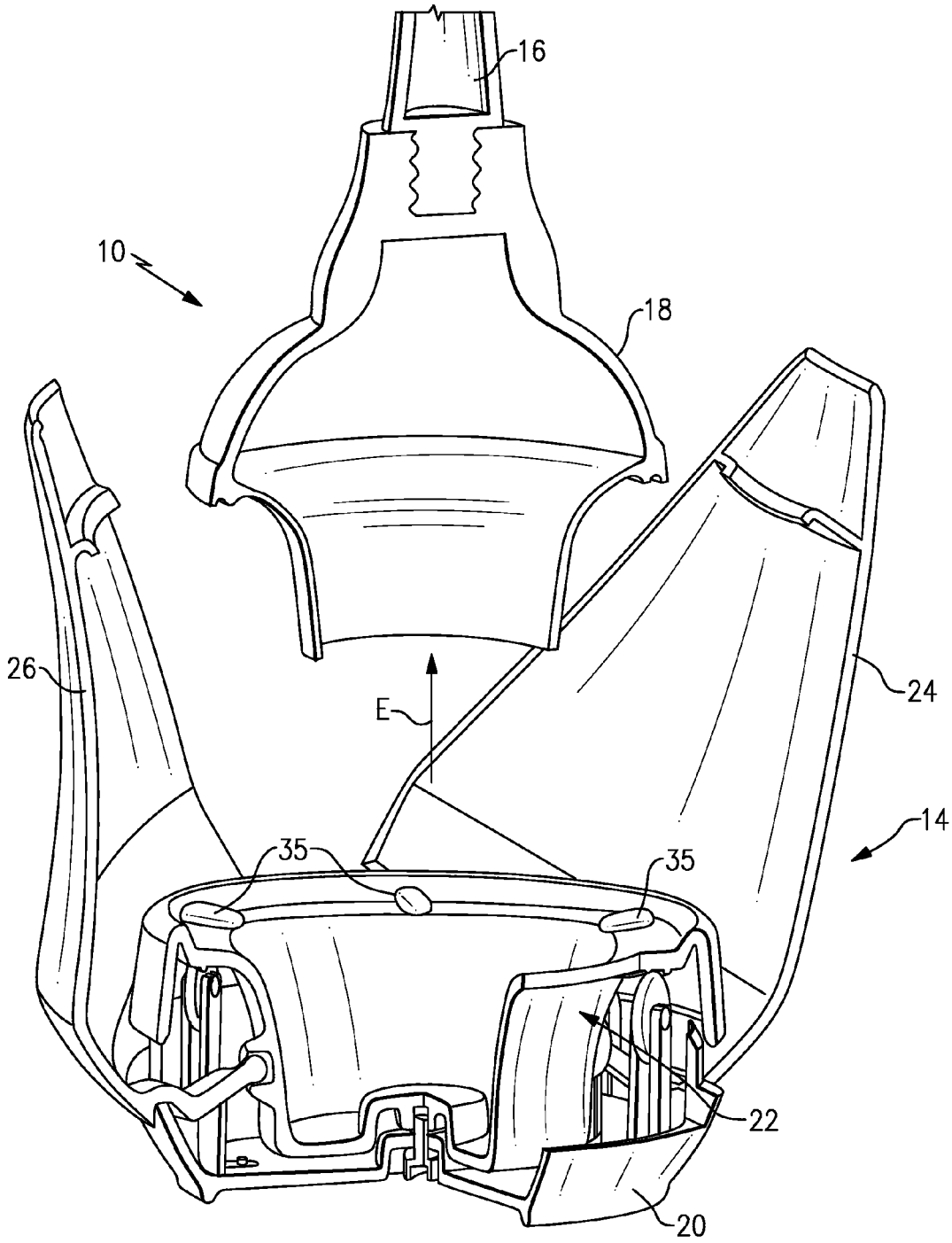

FIGS. 3A and 3B illustrate opening of the plunger caddy assembly 10 to remove the plunger 12 for operation. Rotation of the handle 16 of the plunger 12 in a rotational direction A is translated into rotational movement of the tray 22 relative to the base 20 in a rotational direction B. The rotational movements of the handle 16 and the tray 22 occur about the longitudinal axis C of the handle 16. In one example, the wheels 44 facilitate the rotation of the tray 22 relative to the base 20 via the track 36 of the lip 32. The rotational directions A and B are in a counterclockwise direction, in one example. In another example, the rotation directions A and B are in a clockwise direction.

Rotation of the tray 22 is translated into radial movement of the clamshell doors 24, 26, in one example. The rotation of the tray 22 is translated to the clamshell doors 24, 26 through the cantilevered arms 54. The cantilevered arms 54 pivot about the ledge 62 of the base 20 via the pivot portion 60 to move the clamshell doors 24, 26 in a radial outward direction D. That is, the clamshell doors 24, 26 pivot in opposite directions to separate. Once the clamshell doors 24, 26 separate, the plunger 12 may be removed from the caddy 14. The plunger 12 is removed by lifting the handle 16 in a vertical direction E (See FIG. 3B), for example.

Figure 3C:
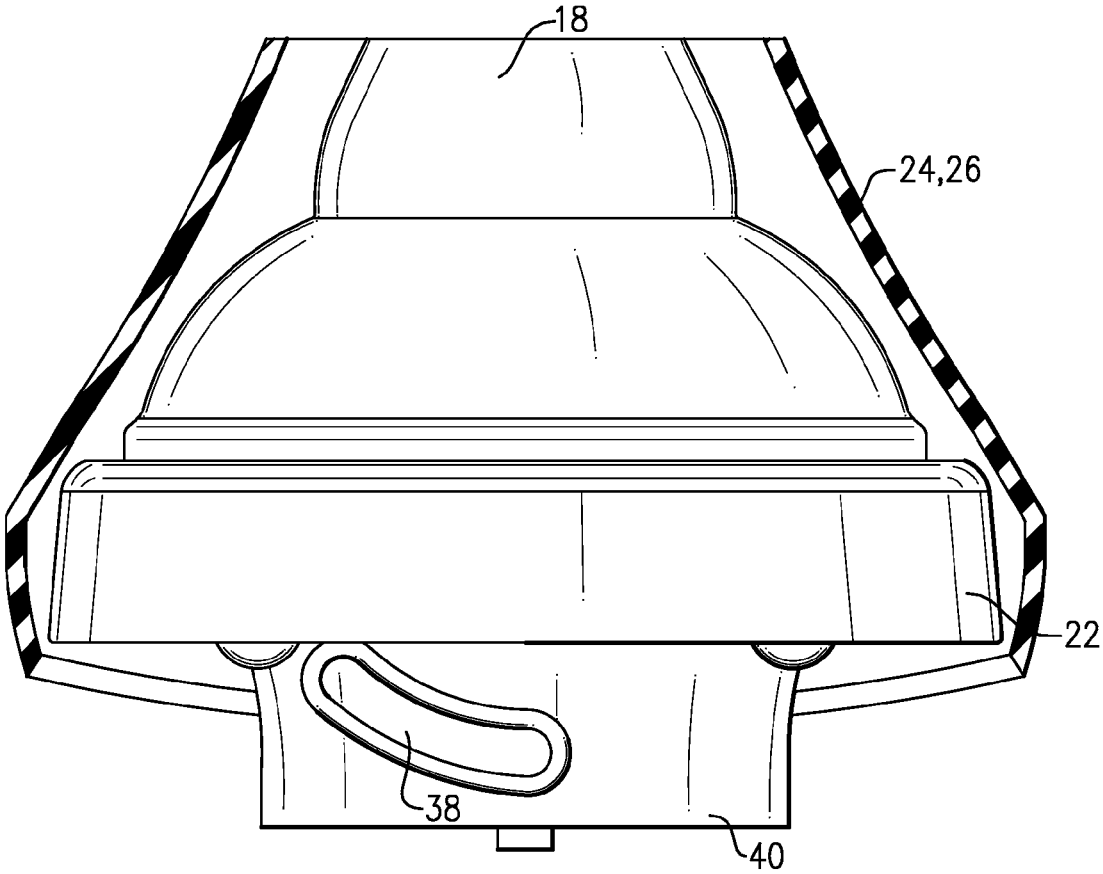
FIG. 3C illustrates one feature of the example plunger caddy assembly of FIG. 1.

FIG. 3C illustrates the indentations 38 of the tray 22. The cantilevered arms 54 of the clamshell doors 24, 26 slide within the indentations 38 in response to rotation of the tray 22. In the illustrated example, the indentations 38 are angled relative to the tray 22. In another example, the indentations 38 are slightly curved and provide a smooth surface for the cantilevered arms 54 to slide and translate therein. The indentations 38 receive the distal ends 58 of the cantilevered arms 54 to provide an interface between the tray 22 and the clamshell doors 24, 26 (See FIG. 2).

Figure 4A:
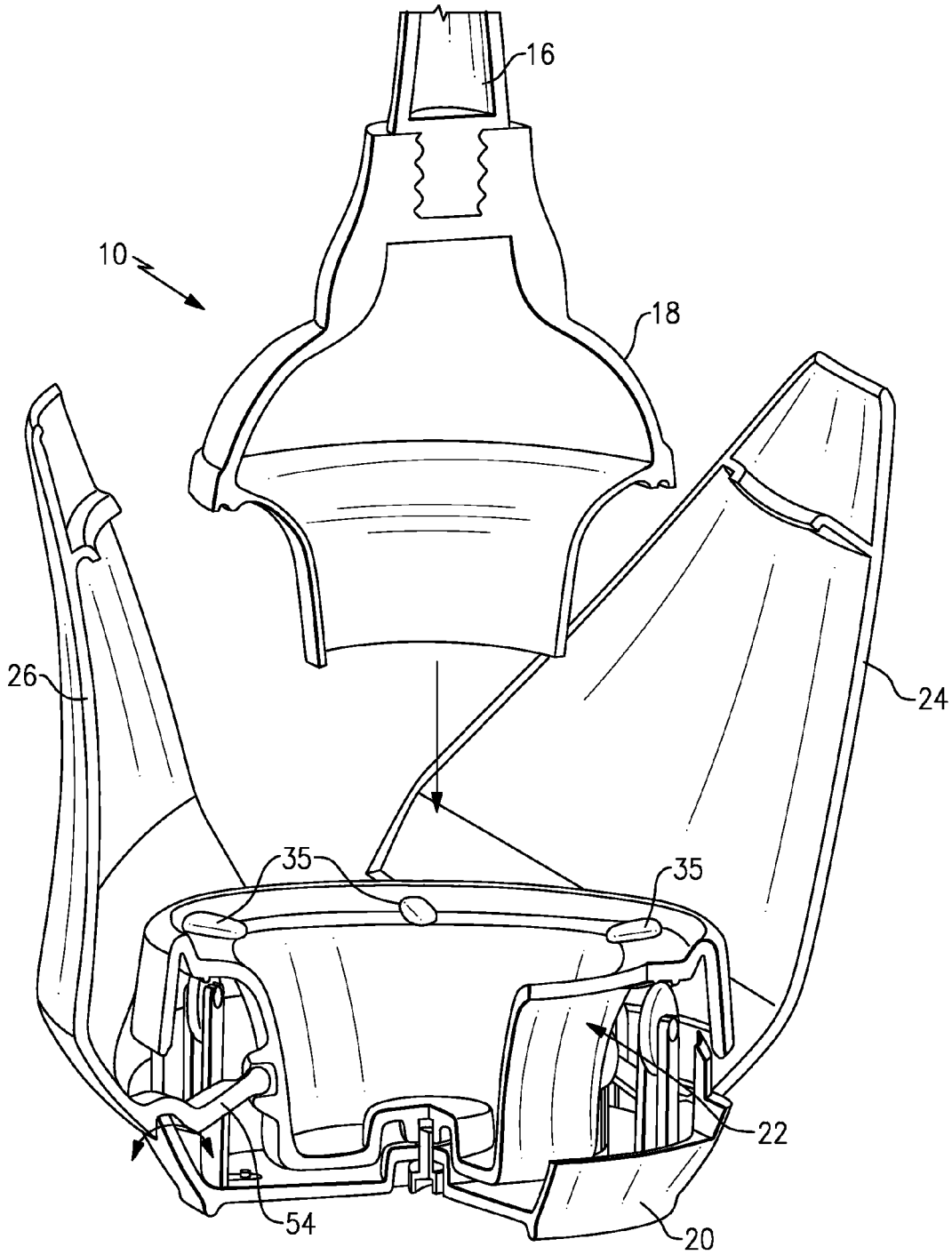
FIGS. 4A and 4B schematically illustrate storage of a plunger within an example plunger caddy assembly.
Figure 4B:
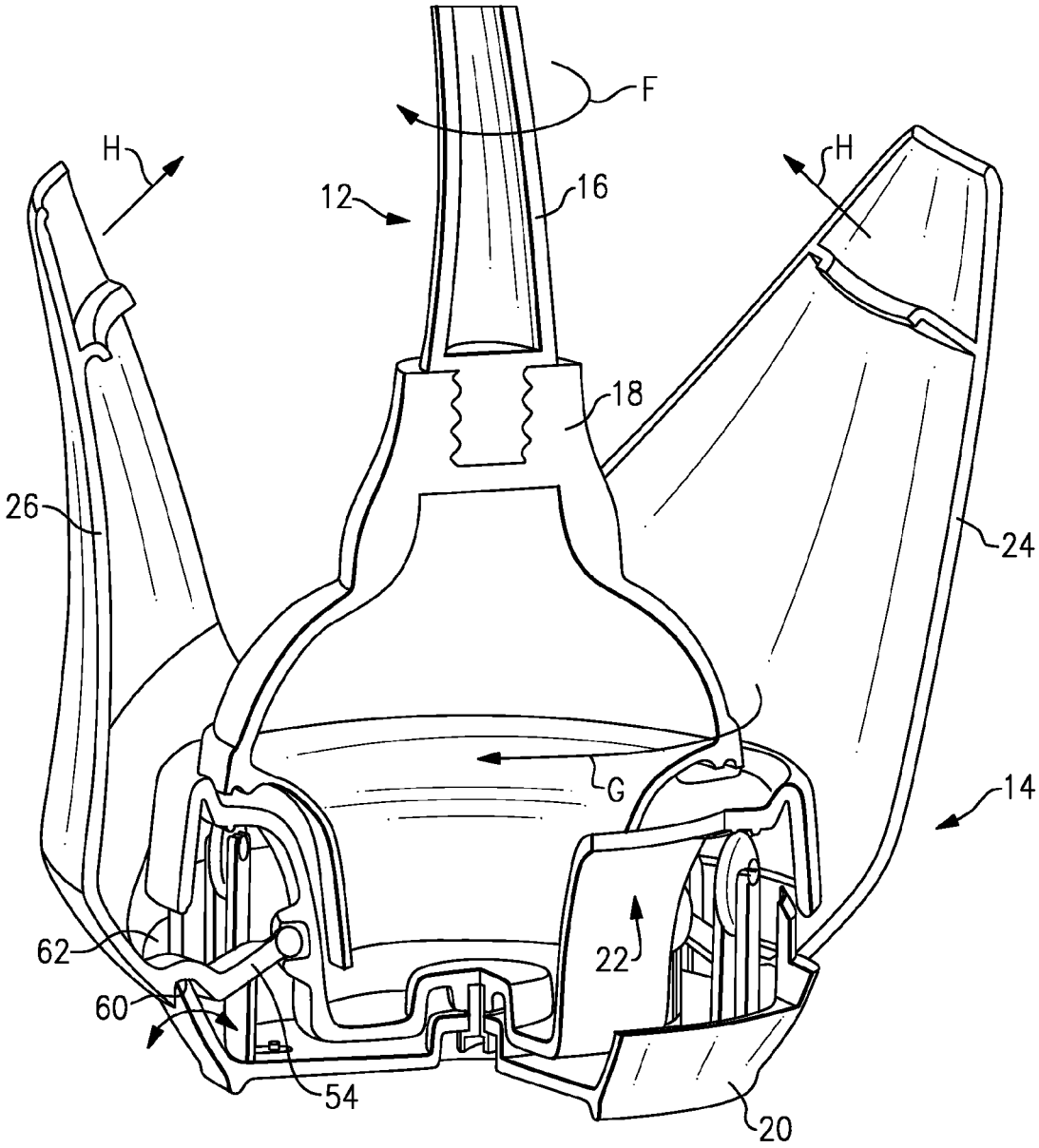

FIGS. 4A and 4B illustrate closing the plunger caddy assembly 10 to store the plunger 12. The suction head 18 of the plunger 12 is first received within the tray 22 (see FIG. 4A). Rotation of the handle 16 of the plunger 12 in a rotational direction F is translated into rotation of the tray 22 relative to the base 20 in a rotational direction G (See FIG. 4B). In one example, the directions F and G are opposite from the directions A and B. That is, the rotational movements required to close the plunger caddy assembly 10 for storage of the plunger 12 occur in an opposite direction from the rotational movements required to open the plunger caddy assembly 10 for release of the plunger 12.

Rotation of the handle 16 of the plunger 12 and the tray 22 in the directions F and G, respectively, are translated into radial movement of the clamshell doors 24, 26. The pivot portions 60 of the cantilevered arms 54 pivot about the ledge 62 of the base 20 in response to rotation of the tray 22. Pivoting of the cantilevered arms 54 closes the clamshell doors 24, 26 about the plunger 12. In one example, the clamshell doors 24, 26 are pivoted in a radial inward direction H.

The rotational movements of the handle 16 and the tray 22 in the directions A, B, F and G are achieved in a hands-free manner relative to the caddy 14. That is, a user is not required to physically contact the caddy 14 to either open or close the plunger caddy assembly 10. Contact need only be made with the handle 16 of the plunger 12. Accordingly, the plunger caddy assembly 10 provides a more sanitary receptacle for storing the plunger 12.

Figure 5:
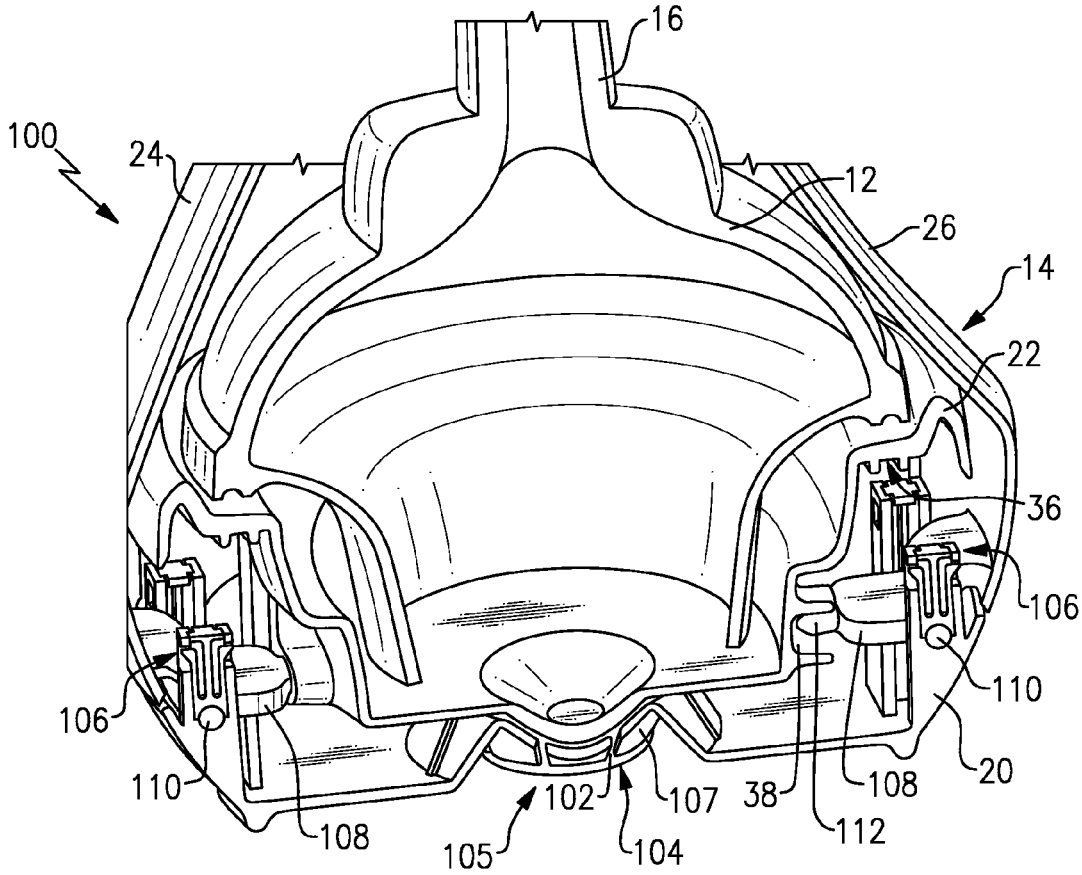
FIG. 5 illustrates another example plunger caddy assembly.

Another example plunger caddy assembly 100 is illustrated in FIG. 5. The plunger caddy assembly 100 is substantially similar to the plunger caddy assembly 10 except for select features. Therefore, where appropriate, like reference numerals are utilized to designate components that are substantially identical between the plunger caddy assembly 100 and the plunger caddy assembly 10.

The example plunger caddy assembly 100 includes a plunger 12 and a caddy 14 for receiving and storing the plunger 12. The caddy 14 includes a base 20, a tray 22 and a pair of clamshell doors 24, 26. The tray 22 is rotatable relative to the base 20. The clamshell doors 24, 26 are pivotally attached to the base 20.

The plunger 12 is received within the caddy 14 for storage. Identical to the plunger caddy assembly 10, rotation of the handle 16 of the plunger 12 within the caddy 14 of the plunger caddy assembly 100 is translated into rotation of the tray 22 relative to the base 20, and is further translated into pivoting of the clamshell doors 24, 26 about the base 20 to separate and open the clamshell doors 24, 26.

Figure 6:
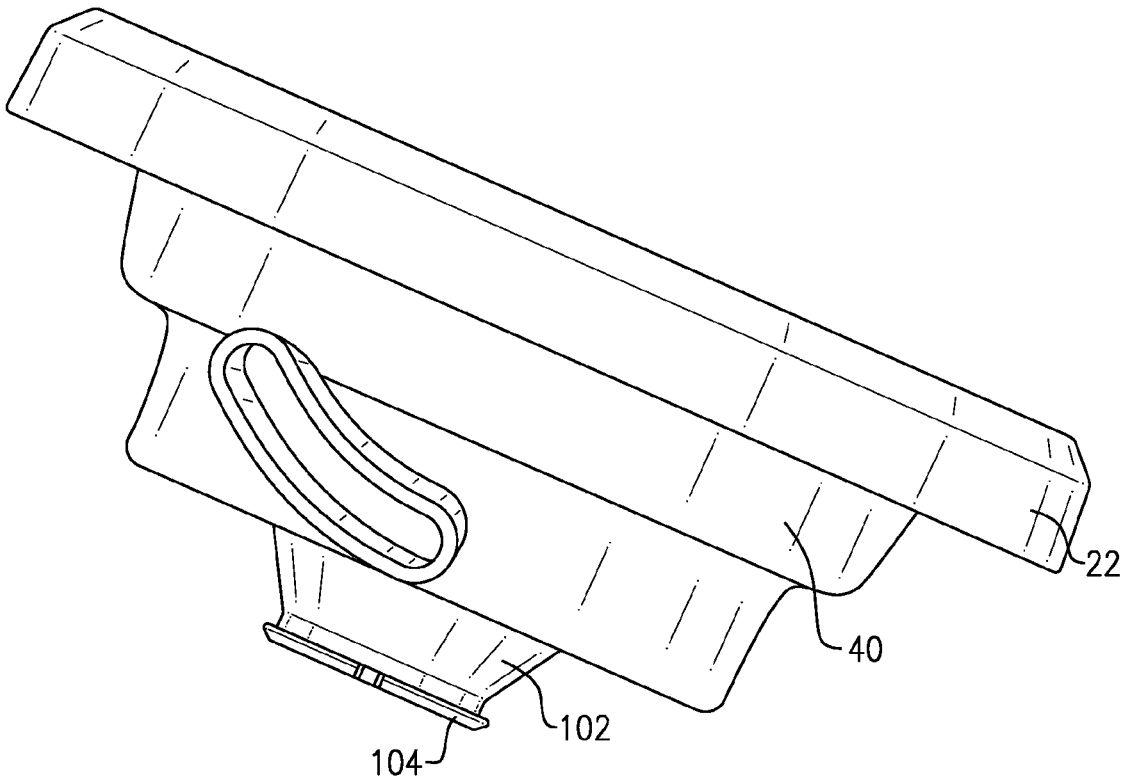
FIG. 6 illustrates an example tray of the plunger caddy assembly of FIG. 5.
Figure 7:
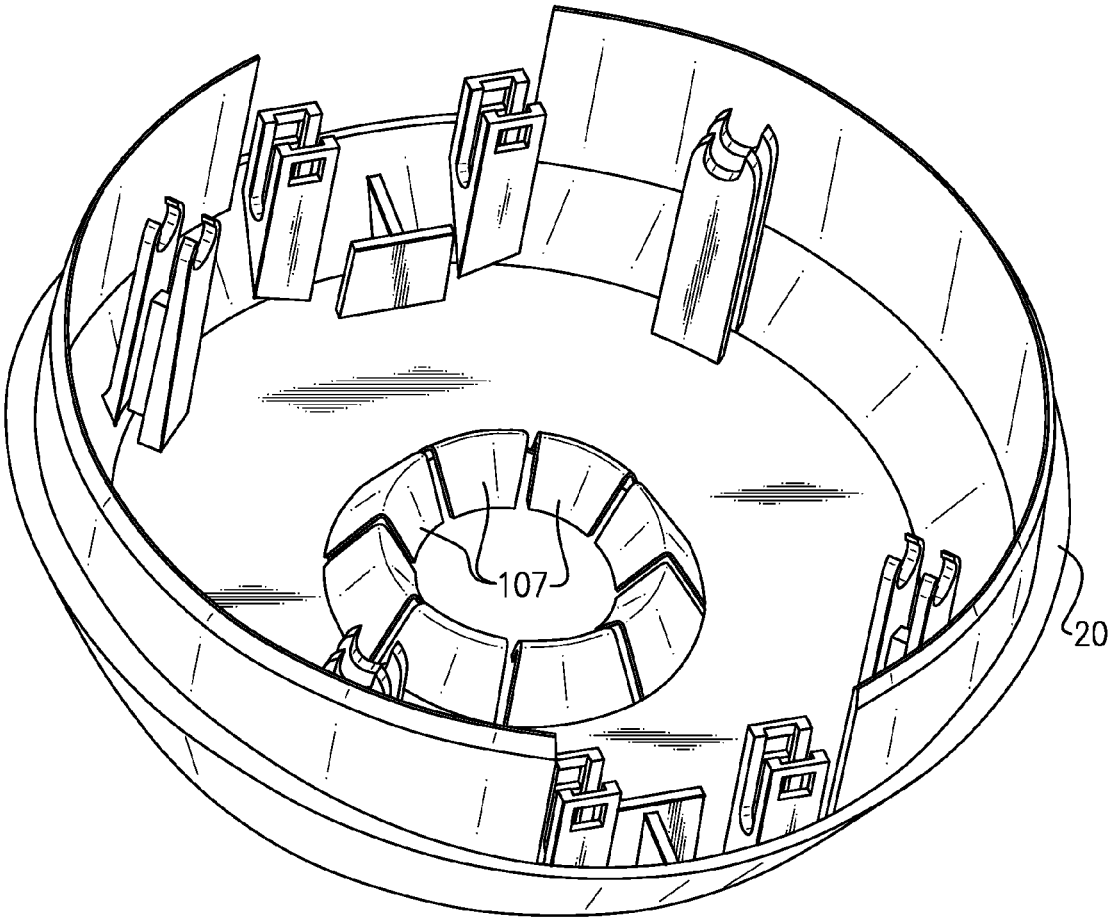
FIG. 7 illustrates an example base of plunger caddy assembly of FIG. 5.

In this example, the tray 22 and base 20 of the plunger caddy assembly 100 form a snap fit assembly 105. The tray 22 includes a boss 102 that extends from the body portion 40 of the tray 22 (See FIG. 6). The boss 102 defines a lip 104 that extends circumferentially about the boss 102 (FIG. 6). The base includes a plurality of snap tabs 107 (See FIG. 7). The lip 104 abuts against the bottom of each snap tab 107 of the base 20 to secure the tray 22 relative to the base 20 (FIG. 7). The snap fit assembly 105 provides for simple axial alignment and vertical retainment of the tray 22 relative to the base 20.

Figure 8:
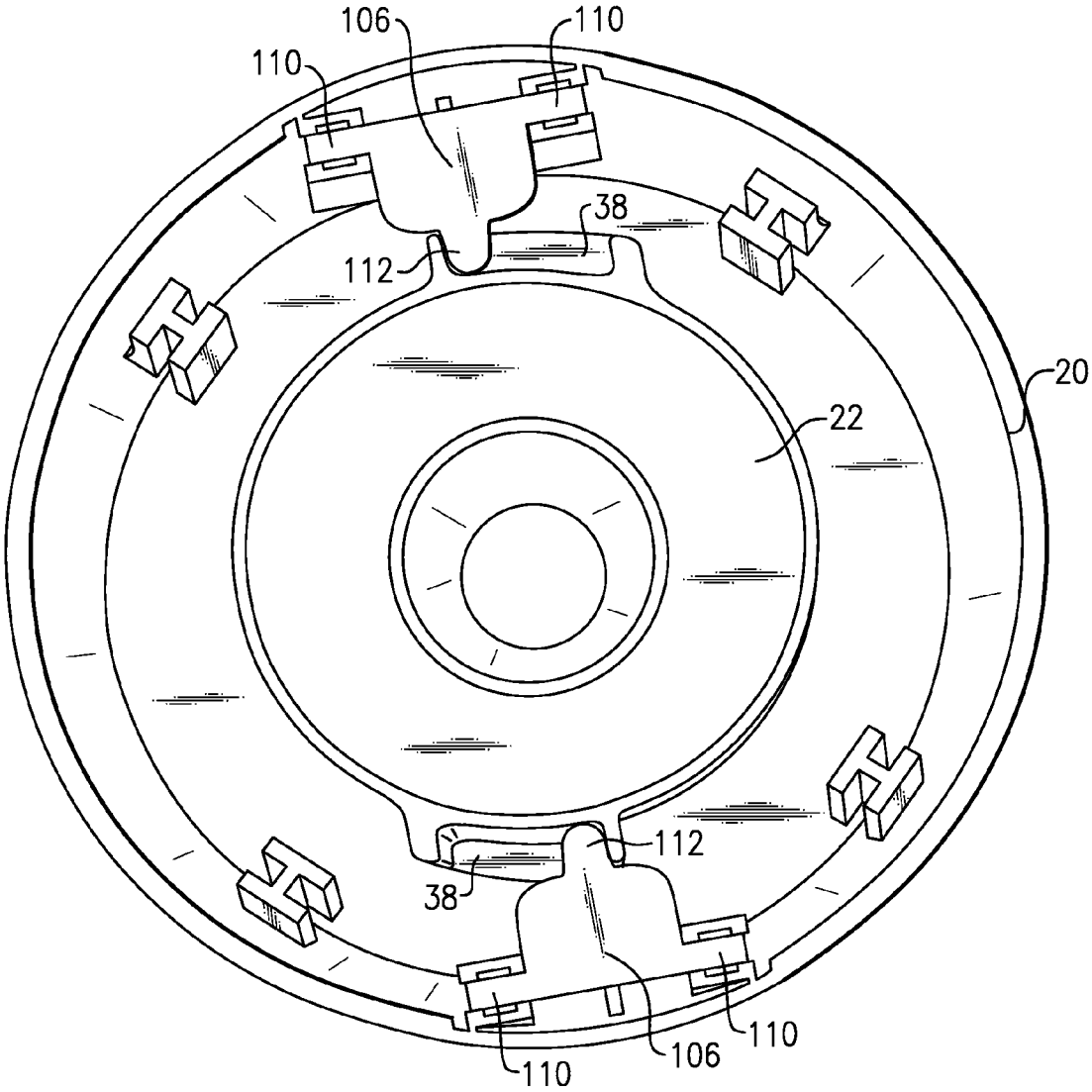
FIG. 8 illustrates example axles of the plunger caddy assembly of FIG. 5.

In this example, the clamshell doors 24, 26 are pivotally attached to the base 20 and tray 22 by a pair of axles 106. Although two axles 106 are illustrated in FIG. 5, the plunger caddy assembly 100 could include any number of axles for pivotally attaching the clamshell doors 24, 26. An arm 108 of each axle 106 slides within the indentations 38 formed within the tray 22 in response to rotation of the tray 22 (See FIG. 8). In one example, a tab 112 of each arm 108 is received by each indentation 38 (FIG. 8). During rotation, the clamshell doors 24, 26 pivot about axle pivots 110 of the axles 106 to move between an open position and a closed position relative to the plunger 12.

Figure 9:
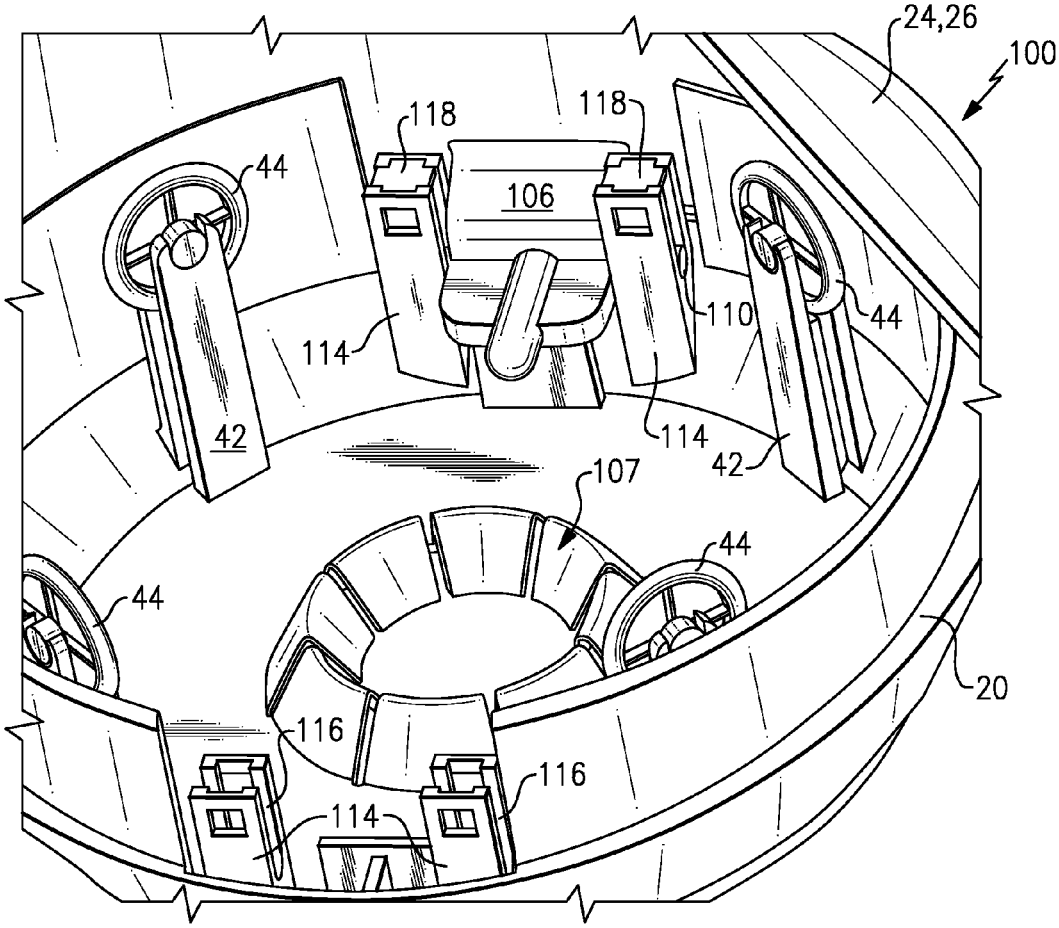
FIG. 9 illustrates attachment of the clamshell doors to the base of the plunger caddy assembly of FIG. 5.
Figure 10:
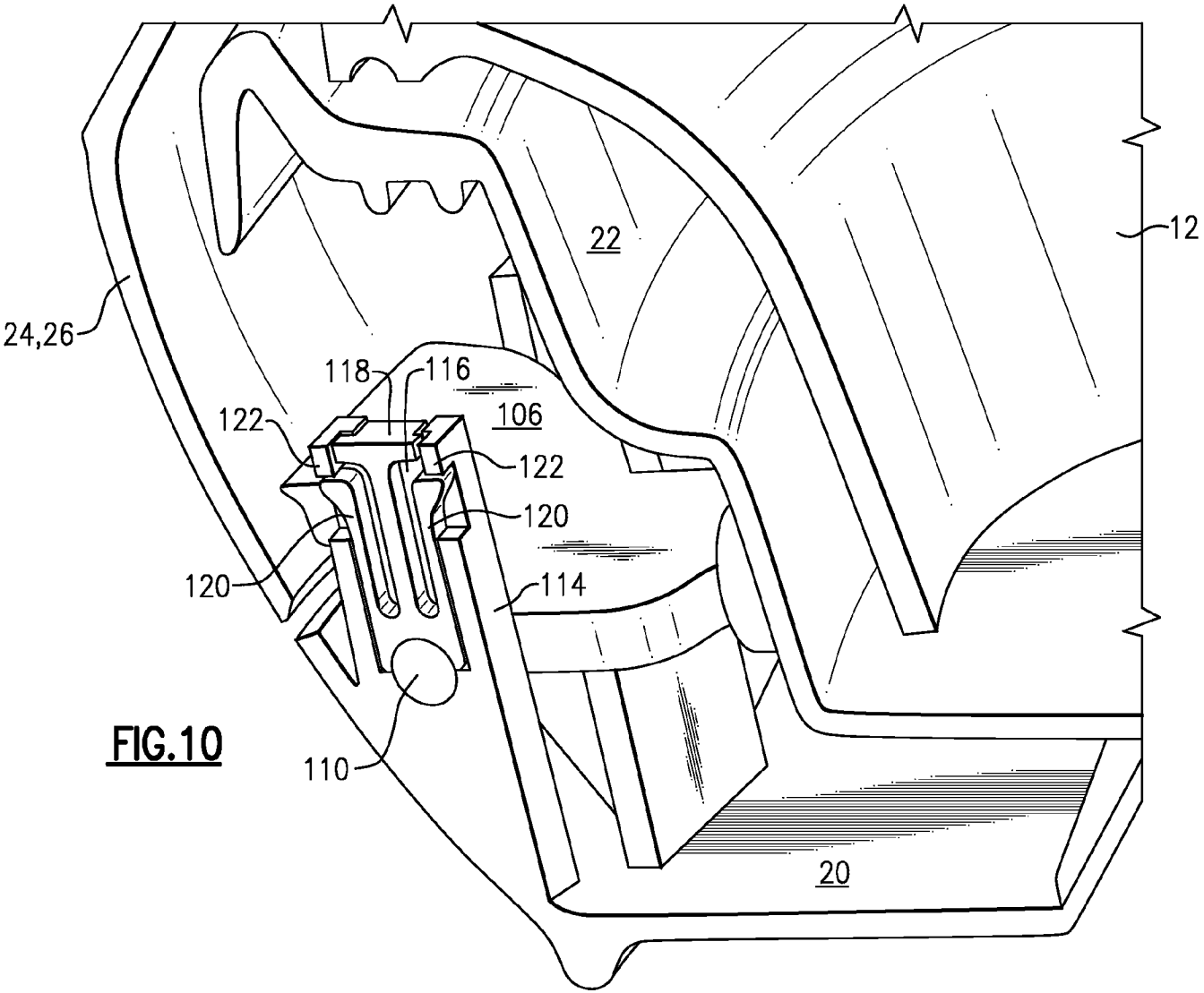
FIG. 10 illustrates a snap connector of the plunger caddy assembly of FIG. 5.

Referring to FIGS. 9 and 10, the base 20 of the example plunger caddy assembly 100 includes a plurality of axle posts 114. The axle posts 114 receive and support the axles 106 of the clamshell doors 24, 26 relative to the base 20. In one example, the base 20 includes four axle posts 114, or two axle posts 114 for each axle 106. However, the actual number of axle posts 114 provide will vary depending upon design specific parameters, including but not limited to, the number of axles 106.

The axle pivots 110 of each axle 106 are received within slots 116 of the axle posts 114. A snap connector 118 is then received within each slot 116 of each axle post 114 to secure the clamshell doors 24, 26 relative to the base 20. The example snap connectors 118 are removable and include arms 120 that abut portions 122 of the axle posts 114 to secure axles 106. Although an example attachment of the clamshell doors 24, 26 relative to the base 20 is illustrated, it should be understood that other attachment methods and techniques are contemplated as within the scope of this disclosure.

In addition, similar to the plunger caddy assembly 10, the plunger caddy assembly 100 includes four wheels 44 received by four posts 42 of the base 20. The wheels 44 are received within the track 36 of the tray 22 to permit rotation of the tray 22 relative to the base 20.

The foregoing description shall be interpreted as illustrative and not in any limiting sense. A worker of ordinary skill in the art would recognize that certain modifications would come within the scope of this invention. For that reason, the following claims should be studied to determine the true scope and content of this invention.

What is claimed is:

1. A plunger caddy assembly, comprising:

a plunger;

a caddy that receives said plunger, wherein said caddy includes a base, a tray received by said base, and a plurality of wheels mounted between said base and said tray, wherein said tray rotates on said wheels relative to said base, and said plunger is selectively rotatable in a first direction relative to said caddy to release said plunger from said caddy and is selectively rotatable in a second direction relative to said caddy to secure said plunger within said caddy; and at least two clamshell doors pivotally connected to said caddy.

2. The assembly as recited in claim 1, wherein said tray is rotatable in said first direction relative to said base to release said plunger from said caddy and is rotatable in said second direction to secure said plunger relative to said caddy.

3. The assembly as recited in claim 1, wherein said at least two clamshell doors move between a closed position and a separated position in response to rotation of said tray relative to said caddy.

4. The assembly as recited in claim 1, wherein said first direction is a counterclockwise direction and said second direction is a clockwise direction.

5. The assembly as recited in claim 1, wherein each of said at least two clamshell doors are pivotally secured to said base with an axle.

6. The assembly as recited in claim 1, wherein said plunger includes a handle, and said plunger is selectively rotated about a longitudinal axis of said handle in each of said first direction and said second direction relative to said caddy to release said plunger from said caddy and secure said plunger within said caddy.

7. A plunger caddy assembly, comprising:

a plunger; and a caddy that selectively receives said plunger, said caddy having a base, a tray received by said base, and at least two clamshell doors contacting one of said base and said tray, wherein said tray is rotatable relative to said base to move each of said at least two clamshell doors between a first position and a second position, wherein said at least two clamshell doors each include at least one cantilevered arm that extends between said at least two clamshell doors and said tray, and rotation of said tray pivots said cantilevered arms to move said at least two clamshell doors between said first position and said second position.

8. The assembly as recited in claim 7, wherein each of said at least two clamshell doors are separated from one another in said second position.

9. The assembly as recited in claim 8, wherein said at least two clamshell doors are non-contiguous in said second position.

10. The assembly as recited in claim 7, wherein each of said at least two clamshell doors is pivotally mounted to said base with an axle.

11. A plunger caddy assembly, comprising:

a plunger; and a caddy that selectively receives said plunger, said caddy having a base, a tray received by said base, and at least two clamshell doors contacting one of said base and said tray, wherein said tray is rotatable relative to said base to move each of said at least two clamshell doors between a first position and a second position, wherein each of said at least two clamshell doors is pivotally mounted to said base with an axle, and said axle includes an arm having a tab that engages an indentation of said tray to pivot said at least two clamshell doors about said axle.

* * * * *